US007719207B2

(12) United States Patent
Huang et al.

(10) Patent No.: US 7,719,207 B2
(45) Date of Patent: May 18, 2010

(54) APPARATUS FOR CONTROLLING LIGHT EMITTING DEVICES

(75) Inventors: Bin-Juine Huang, Taipei (TW); Heng-Lun Tseng, Taipei (TW); Jong-Fu Yeh, Taipei (TW); Po-Chien Hsu, Taipei (TW); Min-Sheng Wu, Taipei (TW); Shing-Tung Chen, Taipei (TW); Kuo-Yang Chen, Taipei (TW)

(73) Assignee: L&C Lighting Technology Corporation, Taipei (TW)

( * ) Notice: Subject to any disclaimer, the term of this patent is extended or adjusted under 35 U.S.C. 154(b) by 145 days.

(21) Appl. No.: 12/043,742

(22) Filed: Mar. 6, 2008

(65) Prior Publication Data

US 2009/0189540 A1 Jul. 30, 2009

(30) Foreign Application Priority Data

Jan. 24, 2008 (TW) ..... 97102667 A

(51) Int. Cl.
*H05B 37/02* (2006.01)

(52) U.S. Cl. ..... 315/294; 315/301; 315/307

(58) Field of Classification Search ..... 315/209 R, 315/224, 246–247, 291, 294, 297, 301, 307–308
See application file for complete search history.

(56) References Cited

U.S. PATENT DOCUMENTS

| | | | | |
|---|---|---|---|---|
| 2008/0012502 | A1* | 1/2008 | Lys | 315/247 |
| 2008/0180040 | A1* | 7/2008 | Prendergast et al. | 315/297 |
| 2008/0238340 | A1* | 10/2008 | Leung et al. | 315/297 |
| 2008/0297067 | A1* | 12/2008 | Wang et al. | 315/294 |
| 2008/0303452 | A1* | 12/2008 | Van Erp | 315/294 |
| 2009/0015172 | A1* | 1/2009 | Huang et al. | 315/246 |
| 2009/0079363 | A1* | 3/2009 | Ghoman et al. | 315/294 |

* cited by examiner

*Primary Examiner*—David Hung Vu
*Assistant Examiner*—Tung X Le
(74) *Attorney, Agent, or Firm*—Squire, Sanders & Dempsey, L.L.P.

(57) ABSTRACT

The present invention is related to the apparatus for driving the light emitting devices with different colors. The input powers of the light emitting devices are measured and controlled by a feedback control system to maintain constant, and by setting different power inputs to the different light emitting devices different stable colors are produced.

16 Claims, 6 Drawing Sheets

APPARATUS FOR CONTROLLING LIGHT EMITTING DEVICES

BACKGROUND OF THE INVENTION

1. Field of the Invention

The present invention generally relates to apparatus for controlling light emitting devices, and more particularly to apparatus for driving light emitting diodes with different spectrums by a feedback control system to produce different stable colors.

2. Description of the Prior Art

For the advantages of less volume, less input power, longer life and lower cost, light-emitting diodes (LEDs) are replacing conventional lighting devices, and novel applications thereof are emerging. For example, various colors could be generated by independently controlling the illuminance (or intensity) of two (or more) LEDs with distinct spectrum (or color) and mixing the color optically.

The LED is composed of N-type semiconductor and P-type semiconductor. The resistance of the interface (or node) between the N-type semiconductor and P-type semiconductor is susceptible to ambient temperature, and subsequently, the illuminance of the LED is likely to be affected by the resistance change. Specifically, the varying ambient temperature may result in an over-heated and over-lighted LED with high output, or alternately may result in an under-lighted LED with insufficient output. For example, in the constant-voltage driving mode when the ambient temperature rises, the interface resistance decreases, causing high operation power and heat for the LED and thus disadvantageously shortens the life of the LED; on the other hand, when the ambient temperature falls, the increased interface resistance causes low operating power for the LED, which renders the LED useless for its insufficient illuminance. Alternatively, in the constant-current driving mode, when the ambient temperature rises, the decreased interface resistance causes low operating power of the LED, which renders the LED useless for insufficient illuminance; and when the ambient temperature falls, the increased interface resistance causes high operating power and heat of the LED, which disadvantageously shortens the life of the LED. Further, the LEDs with different spectrums are susceptible to the ambient temperature with different degrees. Accordingly, it is difficult to precisely arrive at a required color by mixing the different spectrums.

For the foregoing reasons, a need has arisen to propose apparatus for controlling the LEDs that is capable of reducing the temperature affect on the LEDs, protecting to lengthen the life of the LEDs, stabilizing the output illuminance of the LEDs, and precisely mixing the colors of the LEDs.

SUMMARY OF THE INVENTION

In view of the foregoing, it is an object of the present invention to provide apparatus for controlling the LEDs, that is capable of reducing the temperature effects on the operating (or input) power of light emitting devices (such as LEDs), and reducing the unstable input voltage/current effects on the operating power of the light emitting devices. Accordingly, the present invention could protect and lengthen the life of the light emitting devices, stabilize the output illuminance of each light emitting device, and precisely mix the colors of the light emitting devices.

According to the object, the present invention provides apparatus for driving light emitting devices with different colors. The input powers of the light emitting devices are measured by power measuring devices, returned by feedback controllers to control the power input to the light emitting devices, and then individually configured by controlling the luminance of different spectrums, thus obtaining the desired colors.

DETAILED DESCRIPTION OF THE INVENTION

Figure 1A:
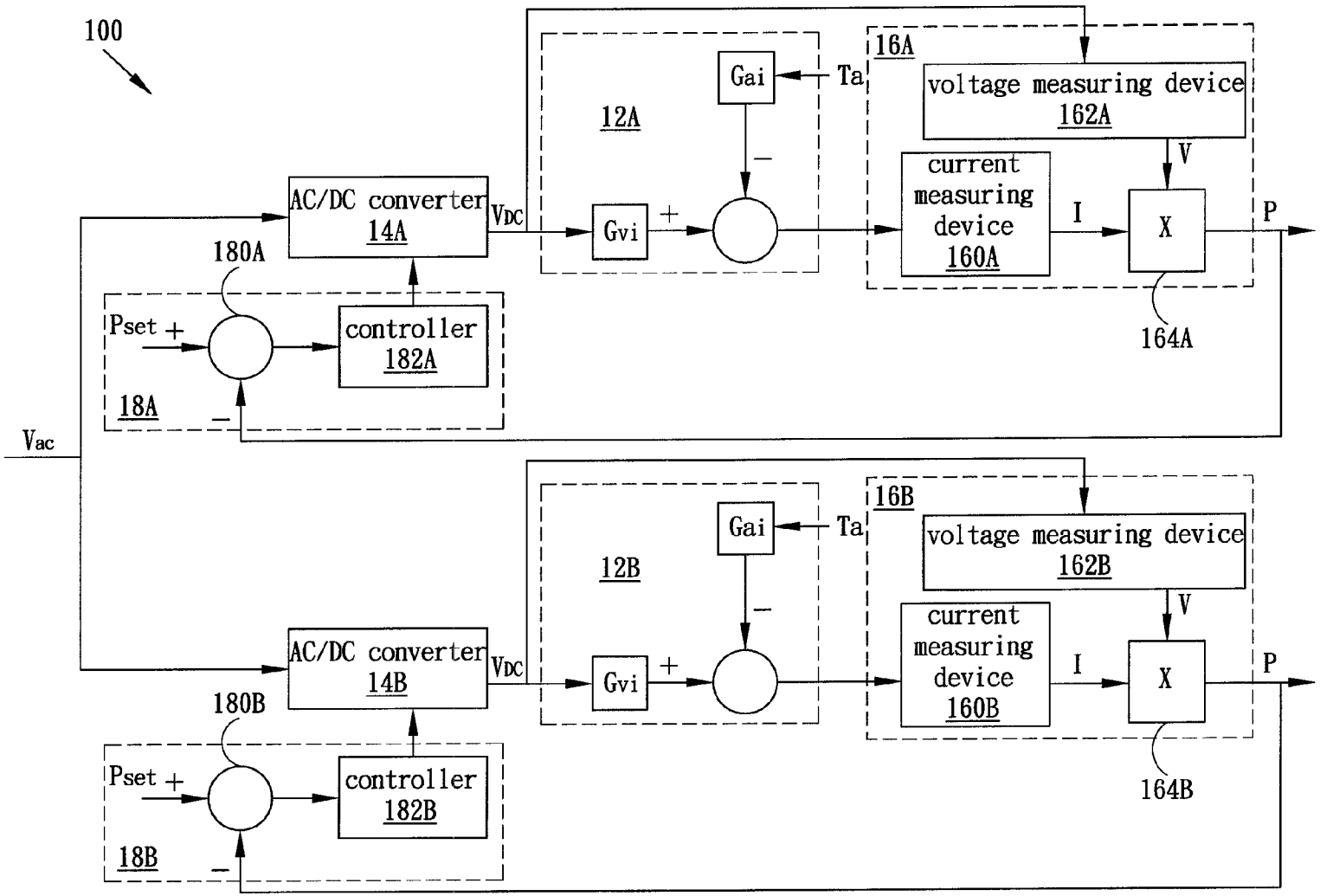
FIG. 1A shows an electrical connecting flow illustrating apparatus for controlling light emitting devices according to one embodiment of the present invention.

FIG. 1A shows an electrical connecting flow illustrating apparatus 100 for controlling light emitting devices according to one embodiment of the present invention. In the embodiment, the light emitting devices are light-emitting diodes (LEDs) 12A and 12B, which have different spectrums (or colors). More than two LEDs with at least two spectrums (or colors) may also be used. The output illuminance of the LED 12A and the LED 12B are independent, and can be controlled to mix optically to arrive at a specific color. For example, light from the LEDs with the three primary colors could be mixed to obtain different colors.

The LEDs 12A and 12B are influenced by input DC (i.e., direct current), voltage $V_{DC}$ and ambient temperature $T_a$. The equivalent circuits of the LEDs 12A and 12B are shown in the figure, in which gain $G_{vi}$ represents the function between the current flowing through the LEDs (12A and 12B) and the input DC voltage, and gain $G_{ai}$ represents the function between the current flowing through the LEDs (12A and 12B) and the ambient temperature.

The input DC voltages $V_{DC}$ to the LEDs 12A and 12B are provided by AC-to-DC (or AC/DC) converters (or adapters) 14A and 14B respectively. The AC/DC converters 14A and 14B convert the AC (i.e., alternating current) voltage $V_{ac}$ (such as the power voltage provided from indoor power outlet) into the DC voltage $V_{DC}$.

The apparatus 100 according to the present embodiment includes two power measuring devices (or detectors) 16A and 16B, which are electrically coupled to the LEDs 12A and 12B for measuring the input power P of the LEDs 12A and 12B respectively. In the embodiment, taking the power measuring device 16A for example, a current measuring device 160A is coupled (in series) to one node of the LED 12A for measuring the current I of the LED 12A; and a voltage measuring device 162A is coupled (in parallel) to another node of the LED 12A for receiving and measuring the DC voltage $V_{DC}$. The detected current I from the current measuring device 160A and the detected DC voltage $V_{DC}$ from the voltage measuring device 162A are inputted to a multiplier 164A whose resultant product represents the power P. With respect to another power measuring device 16B, the operation of its current measuring device 160B, voltage measuring device 162B, and multiplier 164B is the same as the power measuring device 16A. In the embodiment, the power measuring principle P=V×I is used in constructing the power measuring devices 16A and 16B.

The measured powers P from the power measuring devices 16A and 16B are inputted to the feedback controller 18A and 18B respectively, which generate output signals that further control the AC/DC converter 14A and 14B. For example, when the rising/falling ambient temperature changes the input power P of the LEDs 12A and 12B, the feedback controller 18A and 18B change their output signals according to a predetermined reference power $P_{set}$, and further control a digital variable resistor in the AC/DC converter 14A and 14B in order to change the generated DC voltage $V_{DC}$ and the current flowing through the LEDs (12A and 12B), thereby maintaining the input power, the output illuminance, and spectrum (or color) of the LEDs 12A and 12B. Therefore, the apparatus 100 could maintain the specific mixed color.

In the embodiment, taking the feedback controller 18A for example, a substractor 180A is coupled to receive the predetermined reference power $P_{set}$ and the detected power P from the power measuring device 16A, and the resultant difference is inputted to a controller 182A, which controls the AC/DC converter 14A according to the resultant difference, until the power of the LED 12A is equal to the predetermined reference power $P_{set}$. For example, when the resultant difference is negative, the AC/DC converter 14A is controlled (by the controller 182A) to lower the DC voltage $V_{DC}$; alternately, when the resultant difference is positive, the AC/DC converter 14A is controlled to raise the DC voltage $V_{DC}$. The controller 182A may be a circuit, or a program-controlled controller (such as a microprocessor). With respect to another feedback controller 18B, the operation of its substractor 180B and controller 182B is the same as the feedback controller 18A. In other embodiments, the substractors 180A and 180B could be omitted, and the detected power P from the power measuring devices 16A and 16B are inputted into an individual or shared controller, which directly generates corresponding output via, for example, a look-up table, to the AC/DC converter 14A and 14B according to power P. In the present embodiment, the predetermined reference powers $P_{set}$ of the feedback controllers 18A and 18B may be distinct or the same. The aforementioned predetermined reference powers $P_{set}$ are fixed; however they could be dynamically adjusted at different time (or interval) by the controller (or other device) to change the illuminance of the LEDs 12A and 12B according to different applications, thereafter mixing the light to obtain dynamic color lighting.

Figure 1B:
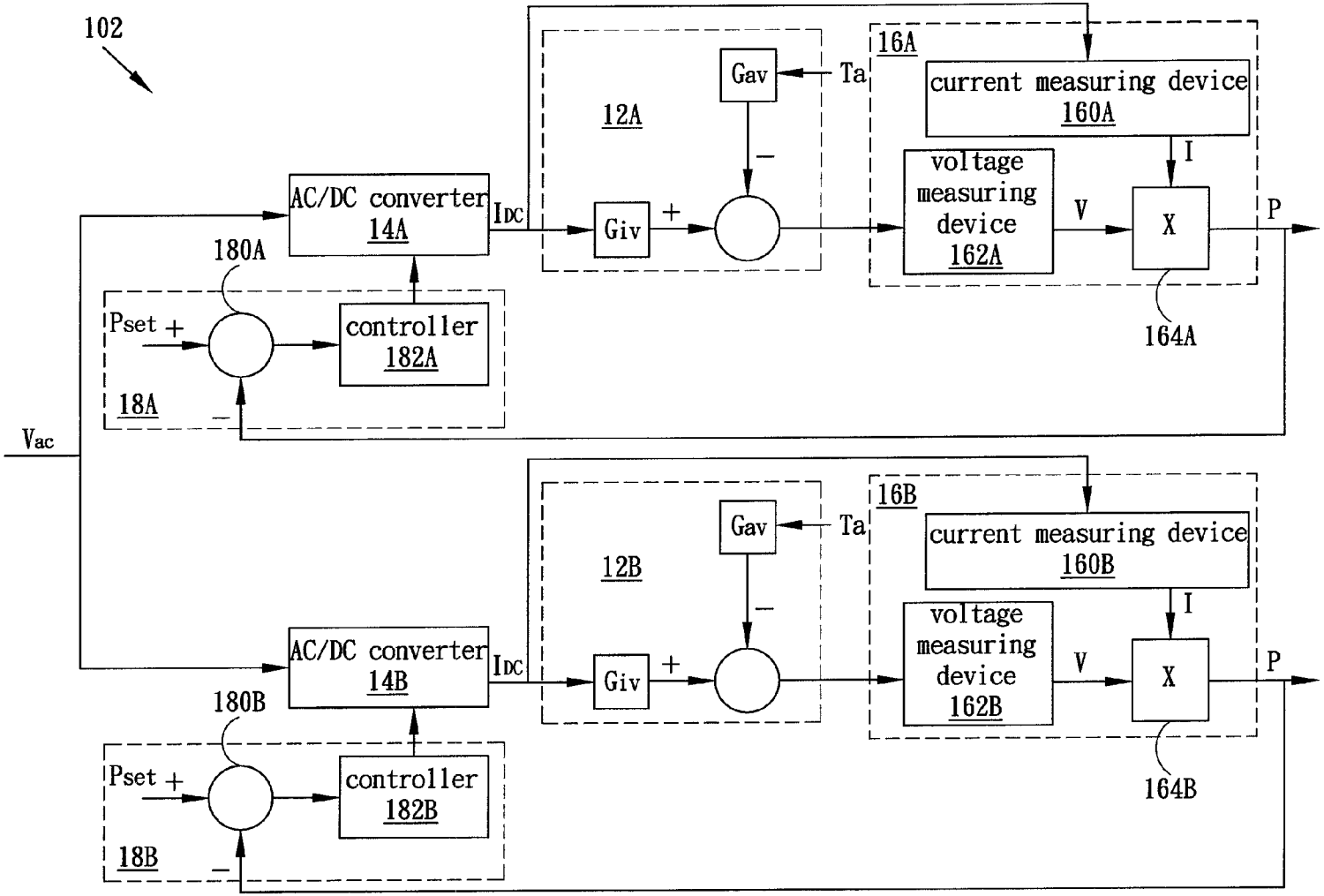
FIG. 1B shows an electrical connecting flow illustrating apparatus for controlling light emitting devices according to another embodiment of the present invention.

FIG. 1B shows an electrical connecting flow illustrating apparatus 102 for controlling light emitting devices according to another embodiment of the present invention. The components such as the LEDs 12A and 12B, and the power measuring devices 16A and 16B are the same as the components of FIG. 1A, using same reference numerals or characters, and therefore their discussion is omitted. The primary difference between the present embodiment and the embodiment of FIG. 1A is the DC current output $I_{DC}$ in the present embodiment rather than the DC voltage $V_{DC}$ in the previous embodiment. Further, in the present embodiment, the equivalent circuits of the LEDs 12A and 12B are shown in the figure, in which gain $G_{iv}$ represents the function between the LED output voltage and the input DC current, and gain $G_{av}$ represents the function between the LED output voltage and the ambient temperature. The present embodiment functions substantially the same as the embodiment of FIG. 1A, that is, the measured powers P from the power measuring devices 16A and 16B are returned to the feedback controller 18A and 18B respectively, which further control the AC/DC converter 14A and 14B, thereby maintaining the input power, the output illuminance, and spectrum (or color) of the LEDs 12A and 12B.

Figure 2A:
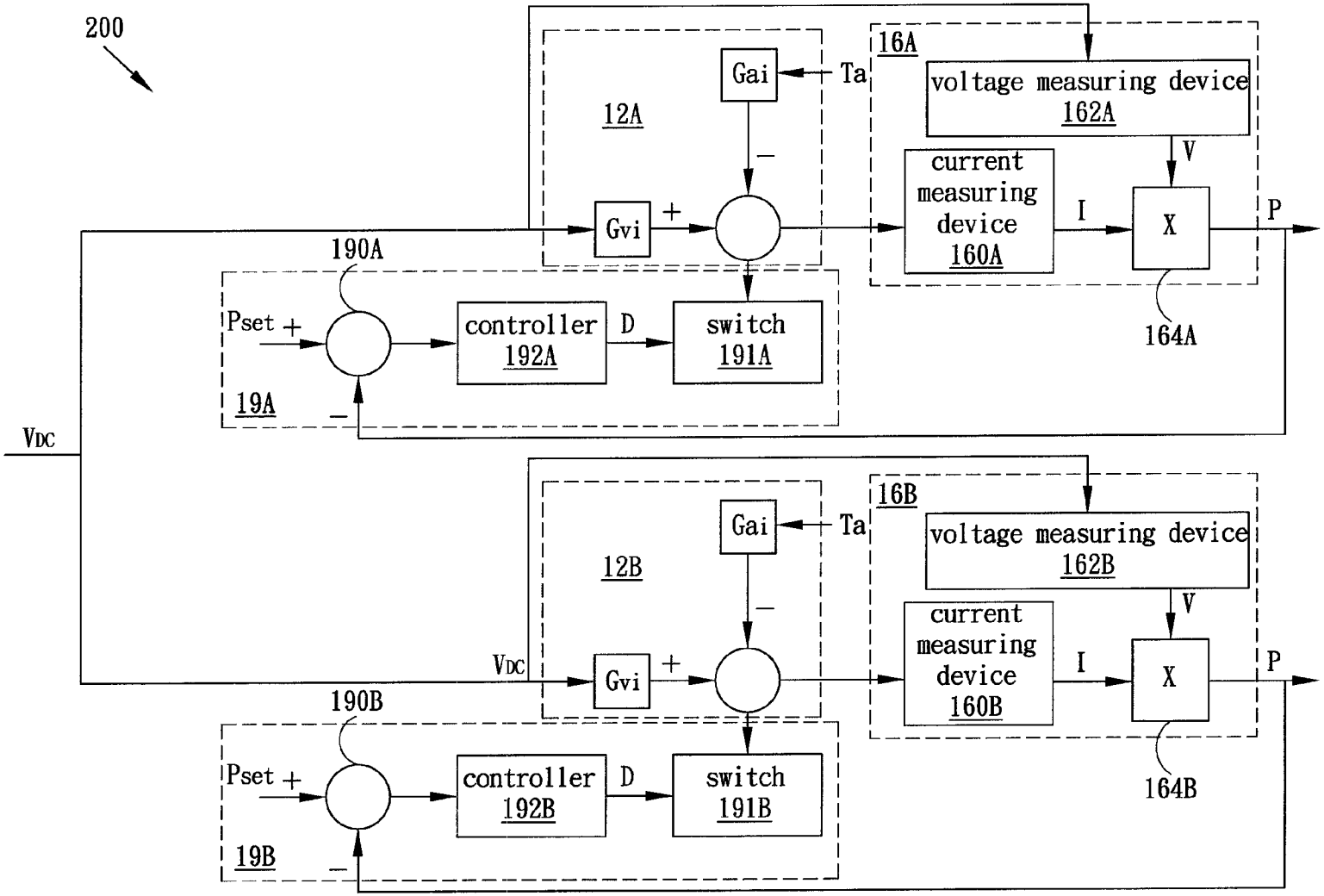
FIG. 2A shows an electrical connecting flow illustrating apparatus for controlling light emitting devices according to another embodiment of the present invention.

FIG. 2A shows an electrical connecting flow illustrating apparatus 200 for controlling light emitting devices according to another embodiment of the present invention. The components such as the LEDs 12A and 12B, and the power measuring devices 16A and 16B are the same as the components of FIG. 1A, using the same reference numerals or characters, therefore their discussion is omitted. In the embodiment, no AC/DC converter is used, and the DC voltage $V_{DC}$ is directly provided by a DC voltage power (not shown). However, an AC/DC converter may be used to provide the DC voltage $V_{DC}$. The value of the DC voltage $V_{DC}$ may fluctuate (such as in solar power or battery) or be fixed (such as in constant-voltage power supply).

The primary difference between the present embodiment and the embodiment of FIG. 1A is the switching (or on-off) current driving of the LEDs 12A and 12B in the present embodiment compared to the continuous current driving of the LEDs 12A and 12B in the previous embodiment. In the present embodiment, taking the LED 12A for example, one node of the LED 12A is coupled in series to a switch 191A of the feedback controller 19A. The LED 12A accordingly emits intermittently owing to the intermittent switching of the switch 191A. The control of the duty cycle of the switch 191A is utilized to control the proportion of light emitting in time, and therefore control the input power P of the LED 12A. Human eyes do not perceive the intermittence when the switching frequency of the switch 191A is high enough. The switch 191A may be a metal oxide semiconductor field effect transistor (MOSFED), or other electronic devices capable of performing switching. With respect to another feedback controller 19B, the operation of its switch 191B is the same as the switch 191A.

In the present embodiment, each of the current measuring devices 160A and 160B and the voltage measuring devices 162A and 162B includes a signal processor that is capable of converting the detected switching current I and the direct voltage $V_{DC}$ into a continuous signal representing the average value, which is then respectively inputted to the multiplier 164A to generate the average input power P of the LEDs 12A and 12B. The measured powers P from the power measuring devices 16A and 16B are fed back to the feedback controller 19A and 19B respectively. $T_a$ king the feedback controller 19A for example, a substractor 190A is coupled to it to receive a predetermined reference power $P_{set}$ and the detected power P from the power measuring device 16A, and the resultant difference is inputted to a controller 192A, which generates a duty cycle control signal D to control the switch 191A and the light emitting of the LED 12A, thereby maintaining the input power, the output illuminance, and spectrum (or color) of the LED 12A. The apparatus 200 is then subjected to light mixing to obtain the desired color stably. With respect to another feedback controller 19B, the operation of its substractor 190B, switch 191B, and controller 192B is the same as the feedback controller 19A.

Similar to the previous embodiment, the controllers 192A and 192B may be circuits, or program-controlled controllers (such as microprocessors). The substractors 190A and 190B could be omitted, and the detected power P from the power measuring devices 16A and 16B are inputted into an individual or shared controller, which directly generates corresponding duty cycle control signals via, for example, a look-up table, to the switches 191A and 191B according to power P.

Figure 3B:
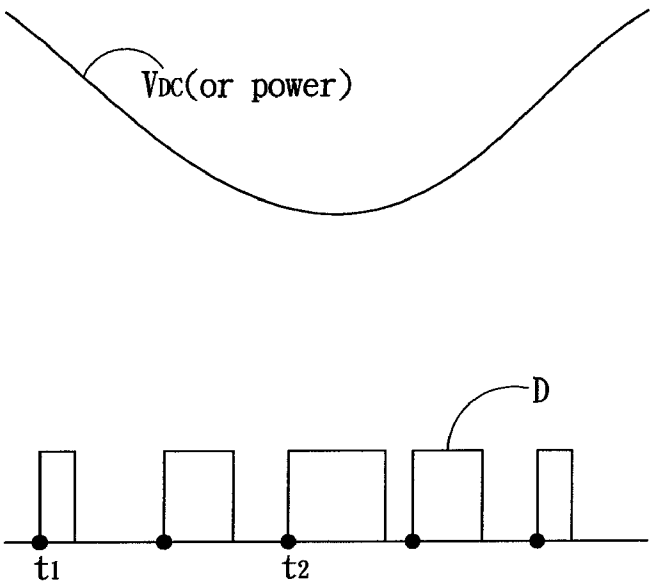
FIG. 3B shows an exemplary waveform illustrating the relationship between the DC voltage (or power) and the duty cycle control signal in FIG. 3A.
Figure 3A:
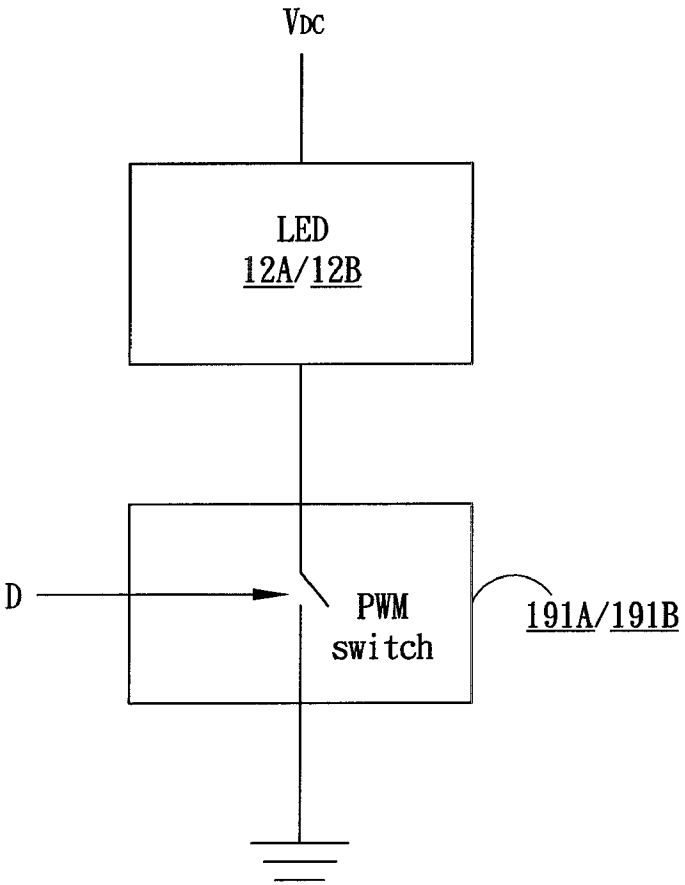
FIG. 3A shows a portion of the apparatus of FIG. 2A, particularly a pulse width modulation (PWM) switch being practiced as the switch.

FIG. 3A shows a portion of the apparatus 200 in FIG. 2A, particularly a pulse width modulation (PWM) switch being practiced as the switch 191A or 191B. One end of the PWM switch 191A/191B is electrically coupled to one node of the LED 12A/12B, and another end is coupled to the ground. FIG. 3B shows an exemplary waveform illustrating the relationship between the DC voltage $V_{DC}$ (or power P) and the duty cycle control signal D in FIG. 3A. As shown in the figure, the DC voltage $V_{DC}$ fluctuates. When the DC voltage $V_{DC}$ (or power P) is overly high, for example, at time $t_1$, the duty cycle control signal has a narrower width, which causes low proportion of light emitting from the LEDs 12A and 12B; alternately when the DC voltage $V_{DC}$ (or power P) is overly low, for example, at time $t_2$, the duty cycle control signal has a wider width, which causes high proportion of light emitting of the LEDs 12A and 12B. Accordingly, the input power of the LEDs 12A and 12B could still be maintained at a fixed value even when the DC voltage fluctuates. Further, when the falling/rising ambient temperature causes the increase/decrease in the P-N interface resistance, the feedback controllers 19A and 19B operate the PWM switches 191A and 191B according to the principle discussed above to maintain the input power. Therefore, the LEDs 12A and 12B could be protected from burned down in an overly high ambient temperature, or be prevented from unsatisfactorily emitting dim light in a cold temperature.

Figure 2B:
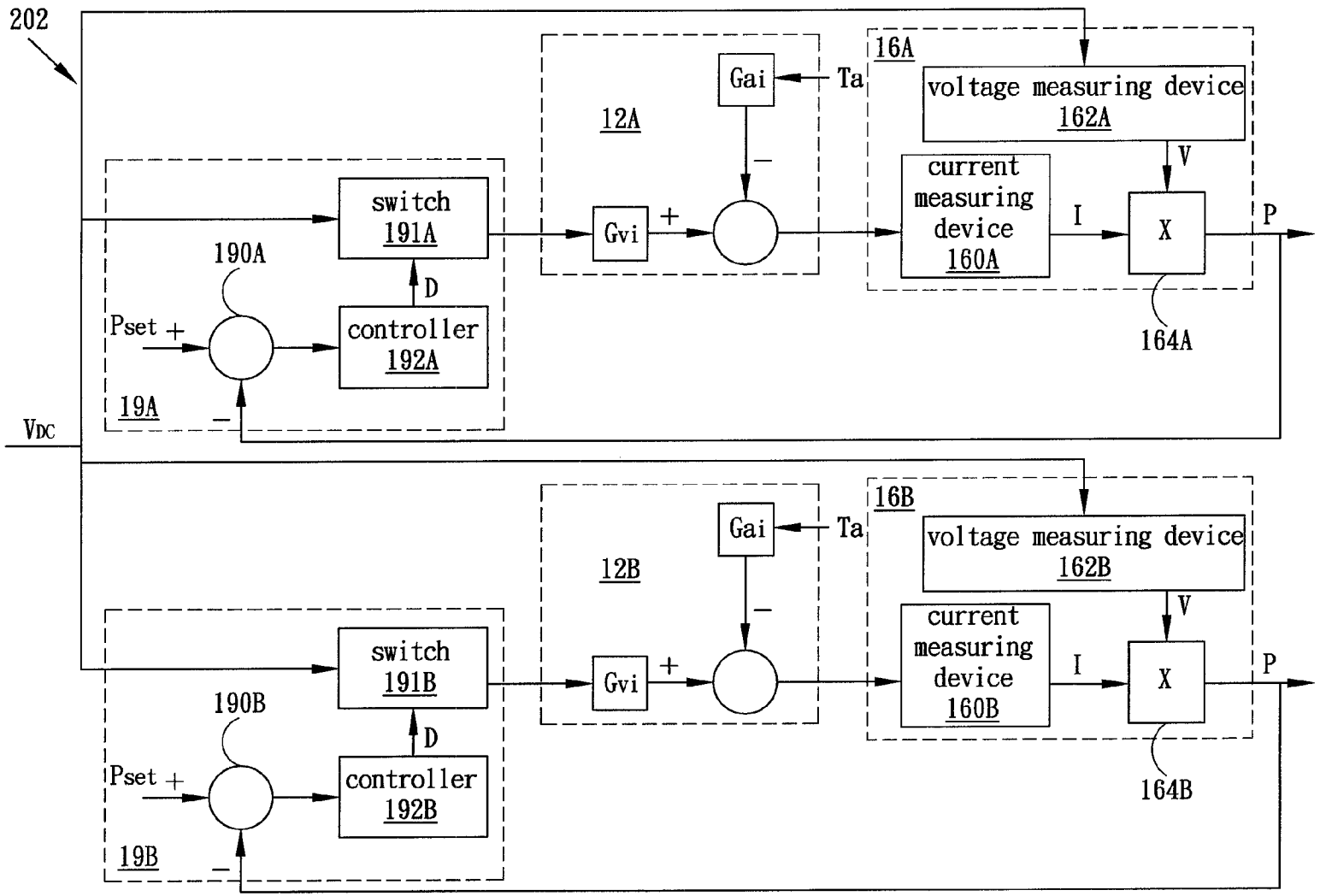
FIG. 2B shows an electrical connecting flow illustrating apparatus for controlling light emitting devices according to further embodiment of the present invention.

FIG. 2B shows an electrical connecting flow illustrating apparatus 202 for controlling light emitting devices according to further embodiment of the present invention. The present embodiment uses the same components as the embodiment in FIG. 2A but is controlled in a different manner. The interconnection of the present embodiment is similar to that in FIG. 1A.

The primary difference between the present embodiment and the embodiment of FIG. 2A is the serial connection of the switches 191A and 191B (for example, PWM switches) and the inputs (rather than outputs) of the corresponding LEDs 12A and 12B in the present embodiment. The outputs of the LEDs 12A and 12B are coupled to the power measuring devices 16A and 16B. Accordingly, the feedback controllers 19A and 19B determine a proper duty cycle under which the DC voltage $V_{DC}$ controllably provides power to drive the LEDs 12A and 12B.

The embodiments discussed above are capable of reducing the temperature effects and the unstable input voltage/current effects on the operating (or input) power of the light emitting devices. Accordingly, the present invention could protect and lengthen the life of the light emitting devices, stabilize the output illuminance of the light emitting devices, and precisely mix the colors of the light emitting devices.

Figure 4:
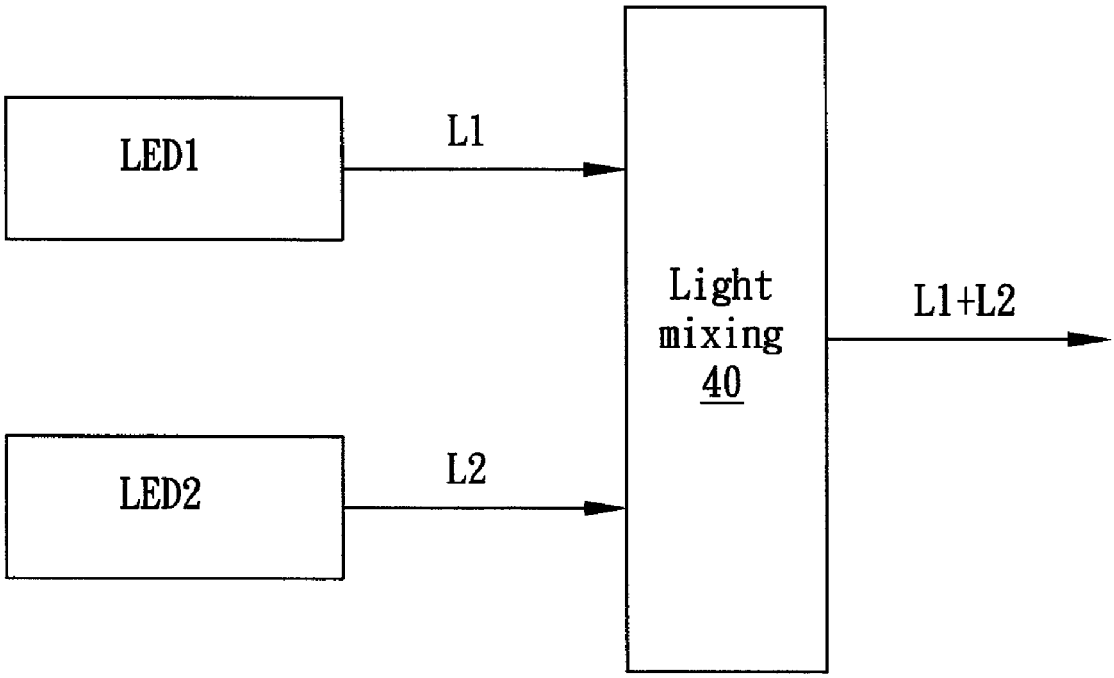
FIG. 4 illustrates mixing two LEDs by a light mixing device to obtain a required color.

FIG. 4 illustrates how a light mixing device 40 mixes two or more LEDs (for example, LED1 and LED2) to obtain a required color. In the embodiment, the LED1 is characterized with a spectrum L1, and the LED2 is characterized with a different spectrum L2. The spectrums L1 and L2 together may compose the required spectrum L1+L2 by arranging the relative position of the LEDs (LED1 and LED2), for example, or by using the accompanied light mixer or reflector. If three LEDs with the three primary colors are used, they could be mixed to obtain various different colors.

Although the specific embodiments have been illustrated and described, it will be appreciated by those skilled in the art that various modifications may be made without departing from the scope of the present invention, which is intended to be limited solely by the appended claims.

What is claimed is:

1. Apparatus for controlling light emitting devices, comprising:

at least two light emitting devices with different spectrums;

at least two power measuring devices for respectively measuring input power of the at least two light emitting devices, wherein each of the power measuring devices comprises:

a current measuring device for measuring current flowing through the light emitting device;

a voltage measuring device for measuring input voltage to the light emitting device; and a multiplier coupled to the current measuring device and the voltage measuring device for multiplying the current by the input voltage to obtain the input power; and at least two feedback controllers for receiving at least two power signals of the at least two power measuring devices, and respectively generating a control signal according to the at least two power signals.

2. The apparatus according to claim 1, wherein the light emitting device is a light-emitting diode.

3. The apparatus according to claim 1, further comprising a DC voltage power for providing DC power to the two light emitting devices.

4. The apparatus according to claim 3, wherein each of the feedback controllers comprises:

a substractor coupled to generate a difference between a predetermined reference power and the input power;

a controller for generating a duty cycle control signal according to the difference; and a switch coupled in series to output of the light emitting devices and controlled under the duty cycle control signal, for controlling the input power of the light emitting device.

5. The apparatus according to claim 3, wherein each of the feedback controllers comprises:

a substractor coupled to generate a difference between a predetermined reference power and the input power;

a controller for generating a duty cycle control signal according to the difference; and a switch coupled in series between the DC voltage power and input of the light emitting device and controlled under the duty cycle control signal, for controlling the input power of the light emitting device.

6. Apparatus for controlling light emitting devices, comprising:

at least two light emitting devices with different spectrums;

at least two power measuring devices for respectively measuring input power of the at least two light emitting devices; and at least two feedback controllers for receiving at least two power signals of the at least two power measuring devices, and respectively generating a control signal according to the at least two power signals;

at least two AC/DC converters for respectively providing DC power to the at least two light emitting devices, wherein the AC/DC converters are controlled by the at least two control signals of the at least two feedback controllers to stabilize the input power of the light emitting devices;

wherein each of the feedback controllers comprises:

a substractor coupled to generate a difference between a predetermined reference power and the input power; and a controller for controlling the AC/DC converter according to the difference.

7. Apparatus for controlling light emitting devices, comprising:

at least two light-emitting diodes (LEDs) with different spectrums;

at least two power supplies for respectively providing DC power to inputs of the at least two LEDs;

at least two power measuring devices for respectively measuring input power of the at least two LEDs, wherein each of the power measuring devices comprises:

a current measuring device for measuring current flowing through the LED;

a voltage measuring device for measuring input voltage to the LED; and a multiplier coupled to the current measuring device and the voltage measuring device for multiplying the current by the input voltage to obtain the input power; and at least two feedback controllers for receiving at least two power signals of the at least two power measuring devices, and respectively generating a control signal according to the at least two power signals.

8. The apparatus according to claim 7, wherein each of the feedback controllers comprises:

a substractor coupled to generate a difference between a predetermined reference power and the input power; and a controller for controlling the power supply according to the difference.

9. The apparatus according to claim 8, wherein predetermined reference power has a plurality of values that are dynamically adjustable to generate different illuminances, which are mixed to generate dynamic color lighting.

10. Apparatus for controlling light emitting devices, comprising:

at least two light-emitting diodes (LEDs) with different spectrums;

a DC voltage power for providing DC voltage to inputs of the at least two LEDs;

at least two power measuring devices for respectively measuring input power of the two LEDs, wherein each of the power measuring devices comprises:

a current measuring device for measuring output current of the LED;

a voltage measuring device for measuring input voltage to the LED; and a multiplier coupled to the current measuring device and the voltage measuring device for multiplying the output current by the input voltage to obtain the input power; and at least two feedback controllers for receiving at least two power signals of the at least two power measuring devices, and respectively generating a control signal according to the at least two power signals.

11. The apparatus according to claim 10, wherein each of the feedback controllers comprises:

a substractor coupled to generate a difference between a predetermined reference power and the input power;

a controller for generating a duty cycle control signal according to the difference; and a switch coupled in series between the DC voltage power and input of the LED, and controlled under the duty cycle control signal, for controlling duty cycle of light emitting from the LED.

12. The apparatus according to claim 11, wherein predetermined reference power has a plurality of values that are dynamically adjustable to generate different illuminances, which are mixed to generate dynamic color lighting.

13. The apparatus according to claim 11, wherein the switch comprises a pulse width modulation (PWM) switch with one end coupled to output of the LED and another end coupled to ground.

14. Apparatus for controlling light emitting devices, comprising:

at least two light-emitting diodes (LEDs) with different spectrums;

a DC voltage power for providing DC voltage to the two LEDs;

at least two power measuring devices for respectively measuring input power of the at least two LEDs, wherein each of the power measuring devices comprises:

a current measuring device for measuring output current of the LED;

a voltage measuring device for measuring input voltage to the LED; and a multiplier coupled to the current measuring device and the voltage measuring device for multiplying the output current by the input voltage to obtain the input power; and at least two feedback controllers for receiving at least two power signals of the at least two power measuring devices, and respectively generating a control signal according to the at least two power signals.

15. The apparatus according to claim 14, wherein each of the feedback controllers comprises:

a substractor coupled to generate a difference between a predetermined reference power and the input power;

a controller for generating a duty cycle control signal according to the difference; and a switch coupled in series between the DC voltage power and the input of the LED, and controlled under the duty cycle control signal, for determining duty cycle under which the DC voltage power controllably provides the DC voltage to the light emitting device.

16. The apparatus according to claim 15, wherein the switch comprises a pulse width modulation (PWM) switch with one end coupled to the DC voltage power and another end coupled to input of the LED.

* * * * *